United States Patent [19]

Geffken

[11] Patent Number: 5,009,178

[45] Date of Patent: Apr. 23, 1991

[54] SELF ACTIVATING KEEL

[76] Inventor: Henry P. Geffken, RR1 Box 29-13, Hereford, Ariz. 85615

[21] Appl. No.: 437,454

[22] Filed: Nov. 14, 1989

[51] Int. Cl.[5] ..... B63B 41/00

[52] U.S. Cl. ..... 114/143; 114/137

[58] Field of Search ..... 114/39.1, 39.2, 122, 114/126, 127, 132, 135–137, 140, 143, 274–276, 284, 285; 441/79

[56] References Cited

U.S. PATENT DOCUMENTS 595,161 12/1897 Gibb ..... 114/137

FOREIGN PATENT DOCUMENTS 349779 3/1922 Fed. Rep. of Germany ..... 114/143

278486 12/1986 Japan ..... 114/126

*Primary Examiner*—Joseph F. Peters, Jr.
*Assistant Examiner*—Jesûs D. Sotelo

[57] ABSTRACT

A keel system for small sailboats. The keel system being comprised of two fins (20P) and (20S) that are allowed to swing on pivots (24) independently, between the hull on which they are mounted and a limiting surface (25). The deployment of fins (20P) and (20S) is controlled by natural hydrodynamic forces acting on activating surface (38) and deactivating surface (36) of tabs (22) built into the tip of fins (20P) and (20S). The invention provides directional stability and improved performance for a boat on all points of sail without the need for crew intervention or interior hull structures.

9 Claims, 6 Drawing Sheets

SELF ACTIVATING KEEL

BACKGROUND-FIELD OF INVENTION

This invention relates mainly to sailboat keels, specifically to such keels which are used on light sailboats that carry little or no intrinsic ballast.

BACKGROUND-DESCRIPTION OF PRIOR ART

Without a keel a sailboat would be blown straight downwind regardless of the direction the boat is pointing. The purpose of a keel is to promote travel in the foreward direction (headway) and inhibit travel in the sideways directions (leeway). The keel accomplishes this by offering maximum surface resistance to leeway and minimum surface resistance to headway.

Wind forces pushing against the sail provide power to the sailboat and also tend to tip or heel the boat over on its side. Small sailboats use the shifting weight of the crew as a significant part of the ballast that counteracts this tendancy for a boat to heel. These boats usually have retractable keels to allow easy beaching and trailoring.

Heretofore, small sailboats have used one of four types of keels. They are: Centerboards, Daggerboards, Leeboards and Bilgeboards. All these arrangements require manipulation by the crew, while under way, for maximum performance. Most of them require trunks built inside the boat that take up valuable space and are difficult to maintain.

The conventional arrangements hang vertically to the horizontal plane of the boat. As the boat heels from wind pressure the keel loses efficiency by swinging toward the windward side of the boat and losing depth. When this happens the high pressure fluid on the lee side of the keel is directed toward the tip thus promoting the phenomenon called tip vortex. The tip vortex occurs when the fluid from the high pressure side of the keel swings around the tip to the low pressure side setting up a swirling of the fluid and compromising the effectiveness of the extremity of the keel.

Leeboards and bilgeboards have the advantage of each being two keels equally spaced from the centerline of the boat. One keel for port tacks and the other keel for starboard tacks. Each can be shaped and pointed for maximum efficiency on its assigned tack but they require even more of the crew's attention since they must be shifted every time the tack is changed.

Daggerboards have a distinct disadvantage since they are not allowed to swing backward in their rigid trunks. If a daggerboard strikes a submerged object with enough force it could cause severe structural damage to the boat.

OBJECTS AND ADVANTAGES

Accordingly, it is the object of the present invention to provide a keel system that can be mounted on a sailboat without the need for an interior fixture or trunk which requires extraordinary maintenance and takes up valuable spaced.

It is also the object of the present invention to provide a keel system that is totally automatic, being activated and deactivated by natural hydrodynamic forces, thus allowing the crew to devote all of its attention to sail trim and boat performance.

It is another object of the present invention to provide a keel system that will safely ride over underwater obstructions and re-deploy when the obstruction is passed without the threat of serious structural damage to the boat.

It is another object of the present invention to improve windward performance by offering two distinct fins in a keel system. Each fin is shaped and pointed at an angle of attack to maximize its performance on its assigned tack.

It is yet another object of the present invention to improve downwind performance, when the need for lateral stability is minimal, by automatically deactivating both fins in the keel system, thus offering minimum resistance to headway.

It is still another object of the present invention to maximize the effectiveness of each fin by deploying them at an acute angle to the direction of horizontal leeward pressure so that as the boat heels the active fin is driven deeper in the water, increasing its efficiency.

It is another object of the present invention to inhibit the tip vortex through the acute angle of deployment of the fins, and a winglet on the tip of each fin in the form of a tab.

Other objects of the present invention will become apparent upon reading the text hereinafter.

DRAWING FIGURES

DESCRIPTION OF INVENTION

Referring to FIGS. 1, 2, 3, 7, 8, 15 and 16, the general structure of an embodiment of the invention is shown in outline.

Figure 1:
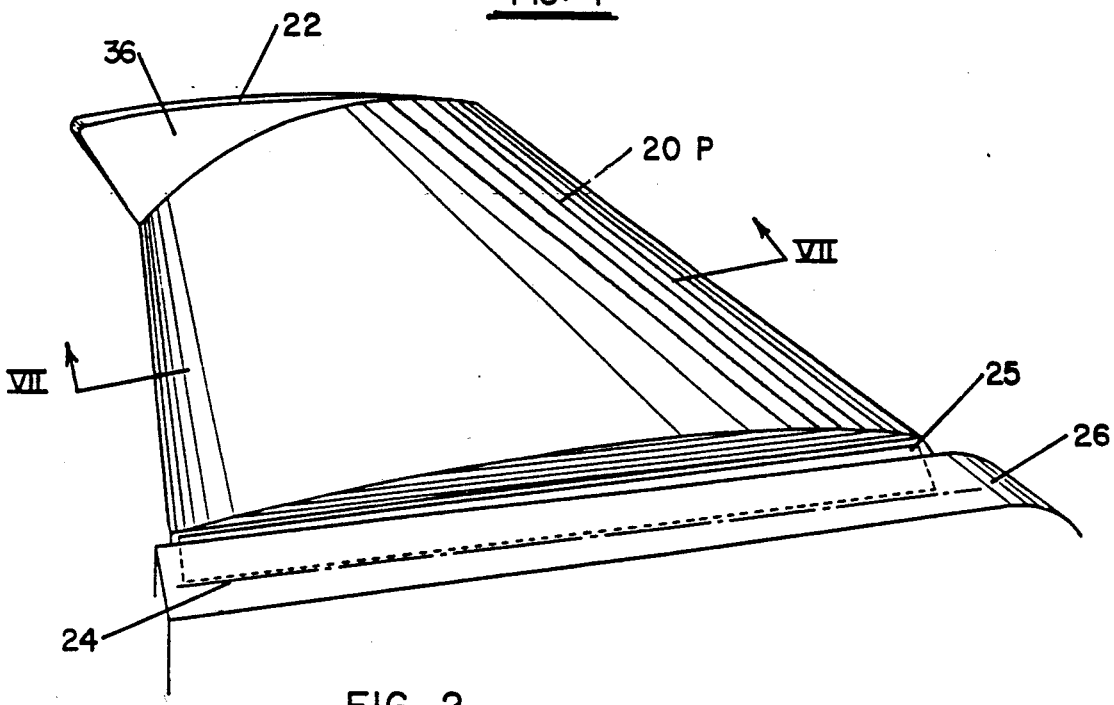
FIG. 1 shows a perspective view of the bottom of a fin.
Figure 2:
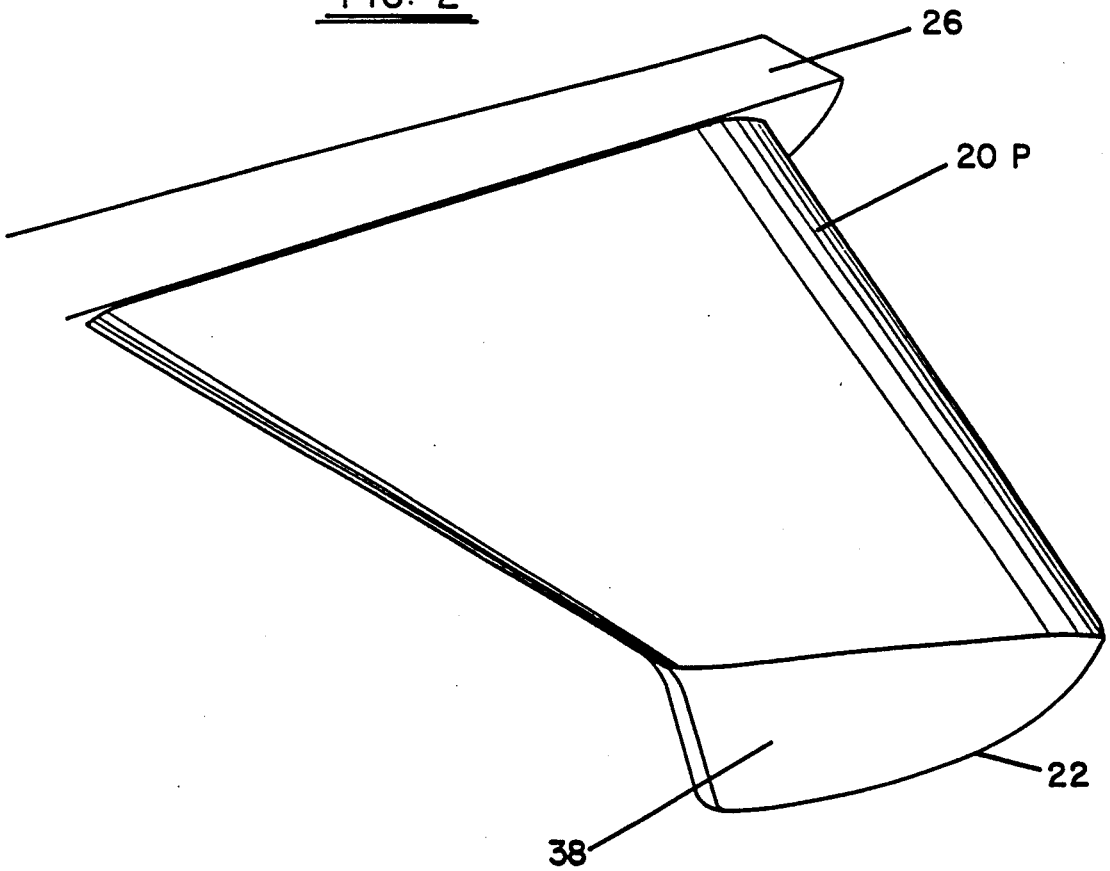
FIG. 2 shows a perspective view of the top of a fin.

A fin 20P, shown in FIGS. 1 and 2, is the primary structural feature of the present invention. The size of fin 20P is approximately three percent of the sail area of the boat on which the invention is to be installed. The leading edge of fin 20P is swept back at an angle of approximately one hundred thirty five degrees from its intended direction of travel.

Figure 7:
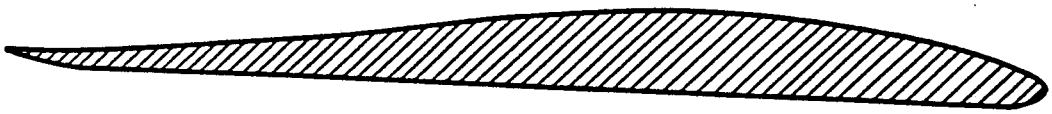
FIG. 7 shows section VII—VII from FIG. 1.

FIG. 7 shows a section taken on line VII—VII of FIG 1. Fin 20P is an airfoil section. In this general embodiment fin 20P conforms to the dimensional parameters of the family of airfoils known by the reference NACA 8-H-12. In FIG. 1 we are looking at the curved surface of the airfoil. FIG. 2 shows the flat surface of the airfoil.

Figure 16:
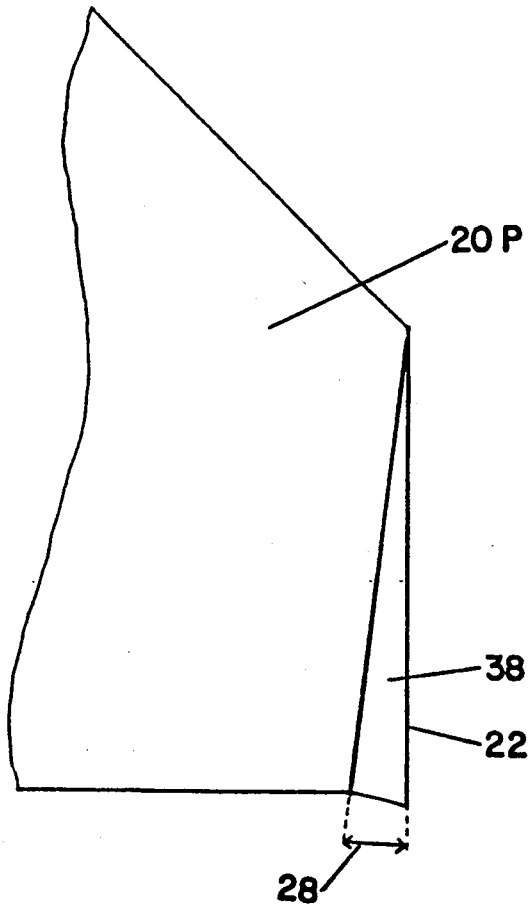
FIG. 16 shows a rear view of a tab and its activating surface.
Figure 15:
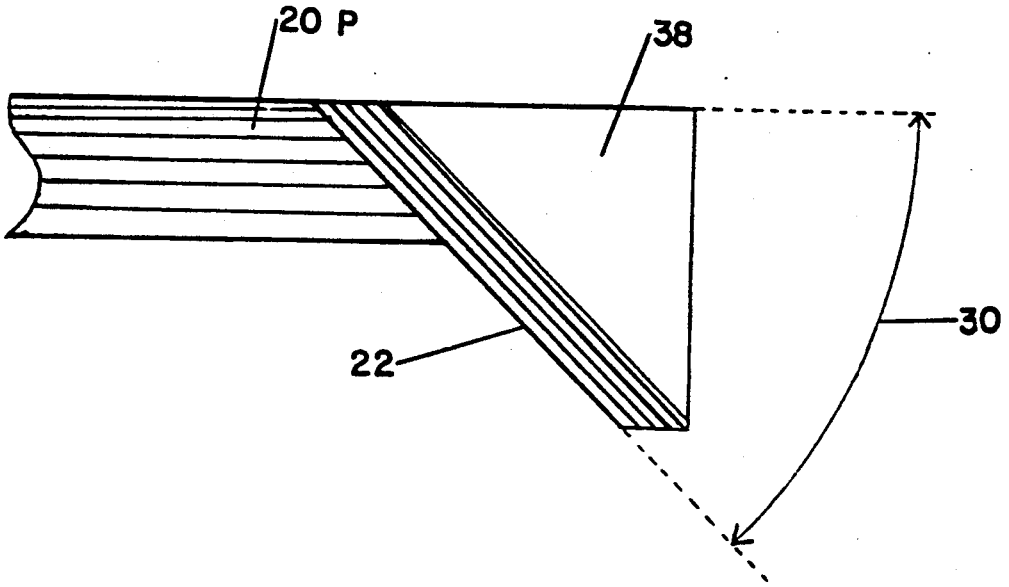
FIG. 15 shows a top view of a tab and its activating surface

A tab 22 is attached to, or shaped into, the tip of fin 20P as a fixed part of the structure. Referring to FIG. 15, angle 28 defines the difference between the intended direction of travel of the craft and the allowable deviation set into tab 22. FIG. 16 shows angle 30 which is defined by the plane of fin 20P and the downward rake of tab 22. In this general embodiment angle 28 is approximately seven degrees and angle 30 is approximately forty five degrees. In order to understand the operation of the invention, it should be noted that tab 22 has a deactivating surface 36 and an activating surface 38.

Figure 8:
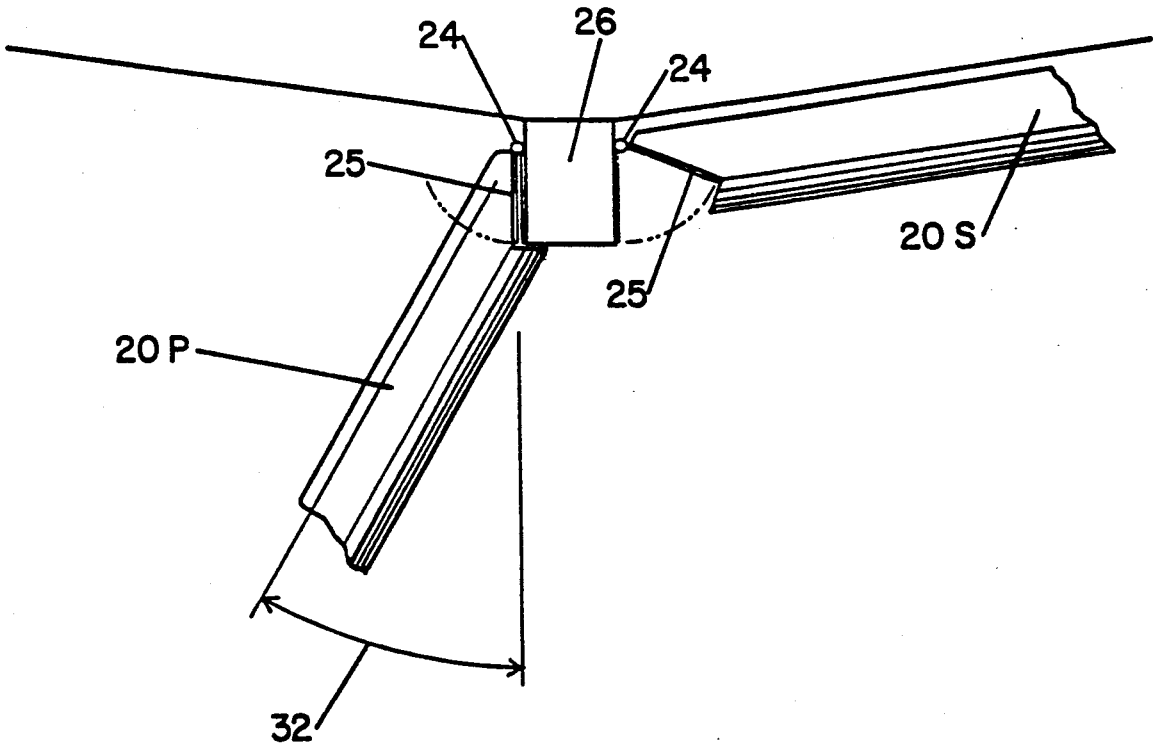
FIG. 8 shows a frontal view of the base of a keel system.

Reffering to FIGS. 1 and 8, fin 20P has an angle 32 built into its root that is defined by the plane of fin 20P and a limiting surface 25. In this general embodiment, angle 32 is approximately thirty degrees. Fin 20P is attached to a base 26 by a hinge 24 that allows fin 20P to swing freely between the hull of the craft and limiting surface 25. Base 26 is tapered to windward approximately two degrees from back to front in order to increase the angle of attack of fin 20P.

Figure 3:
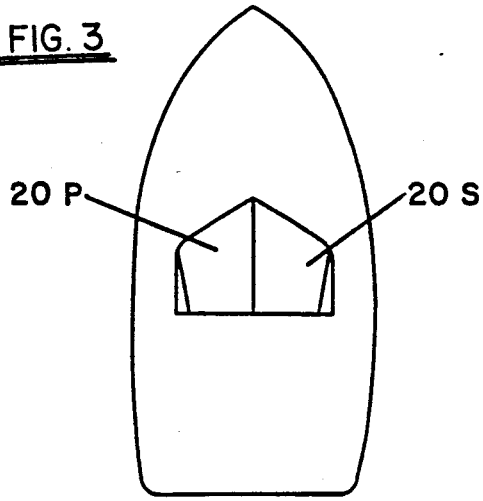
FIG. 3 shows a bottom view of a boat with a lee keel arrangement.

FIG. 3 shows fin 20P and its mirror image fin 20S to depict a keel system in the lee keel arrangement. Base 26 of the keel system is attached to the bottom of a sailboat as shown in FIG. 8. In this general embodiment base 26 is aligned along the centerline of the craft as shown in FIG. 3.

In this general embodiment the entire keel system, which includes fins 20P and 20S with their tabs 22 and base 26, is fashioned from a hard wood such as oak or mahogany. Hinge 24 is a piano hinge cut to the appropriate size as shown.

Figure 9:
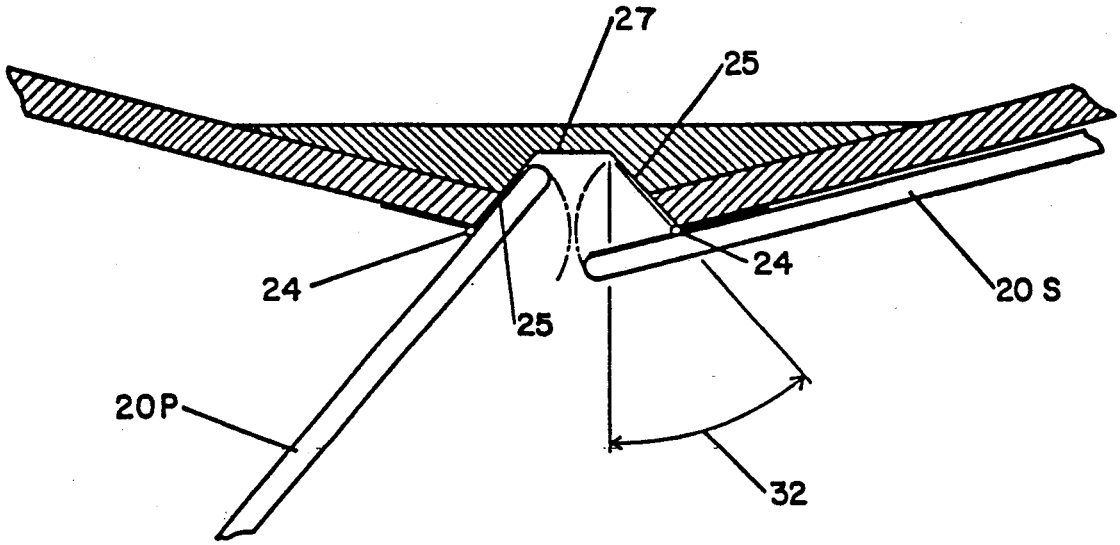
FIG. 9 shows a frontal view of an alternate base of a keel system.

FIG. 9 shows an alternate means of limiting the swing of fins 20P and 20S on hinges 24. In this general embodiment, angle 32 and limiting surface 25 are built into an alternate base 27 which is mounted flush with the skin of the hull of a sailboat. Hinges 24 are attached to fins 20P and 20S a distance from their roots, as shown in FIG. 9, so that the swing of fins 20P and 20S will be limited by surfaces 25 without jamming.

Figure 10:
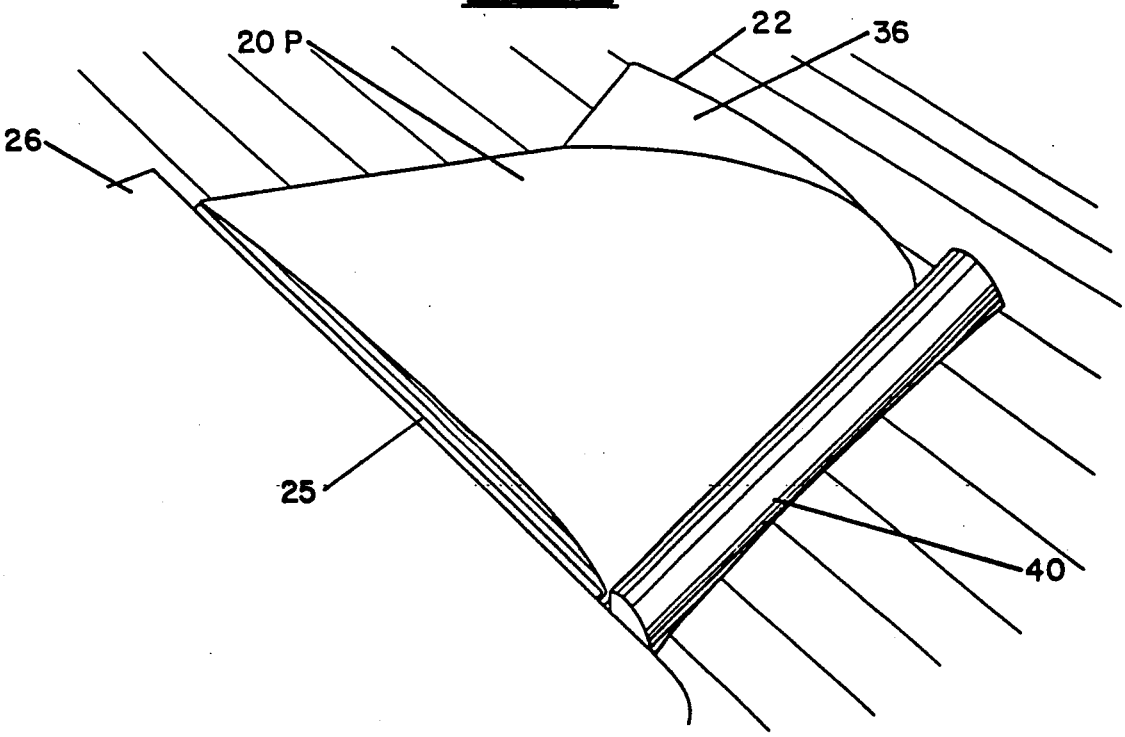
FIG. 10 is a perspective view of the bottom of a fin showing a fairing fixed to the body of a craft foreward of the fin.

FIG. 10 shows a fairing 40 attached to the hull of a boat. In this illustration fairing 40 is positioned in front of the leading edge of fin 20P. Fairing 40 may be fashioned out of hard wood, such as oak or mahogany, and fixed to the hull with a waterproof glue.

Figure 11:
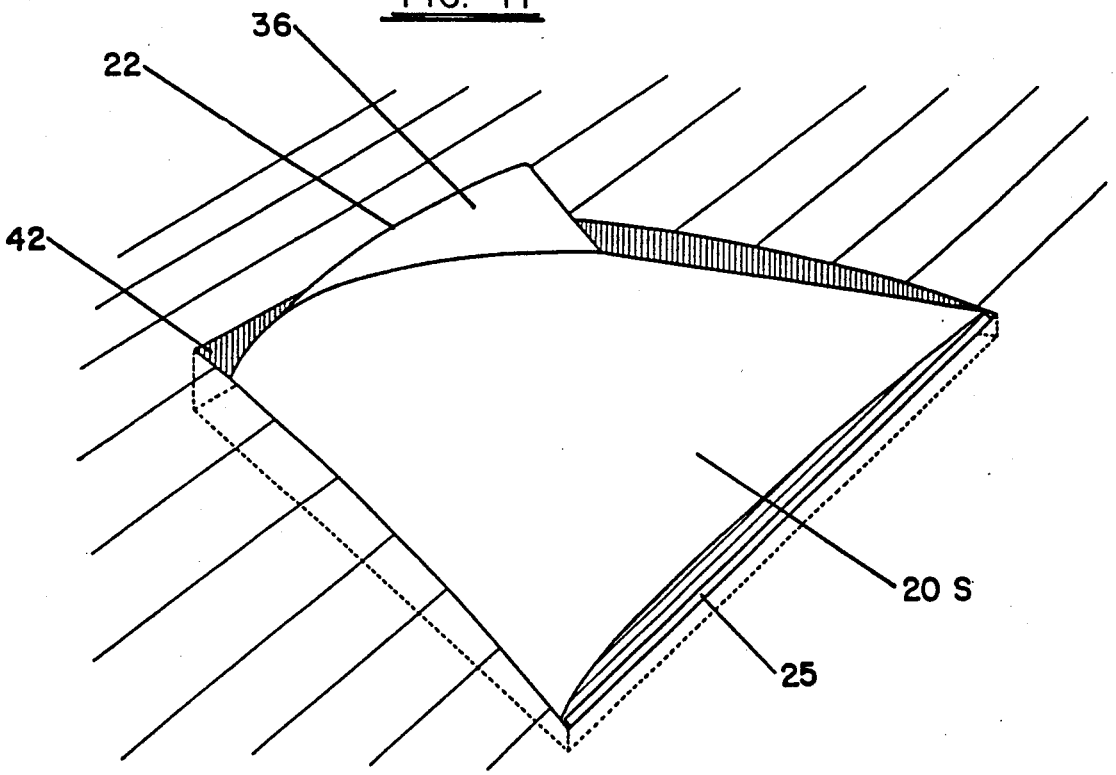
FIG. 11 is a perspective view of the bottom of a fin showing the fin resting in a nest built into the body of a craft.

A nest 42 may be formed into the hull of a sailboat as shown in FIG. 11. Nest 42 should be formed to accept the shape of a deactivated fin 2OS. While resting in nest 42 most of fin 20S is sheltered from the main stream of fluid flow, however tab 22 remains exposed to the fluid flow.

Figure 13:
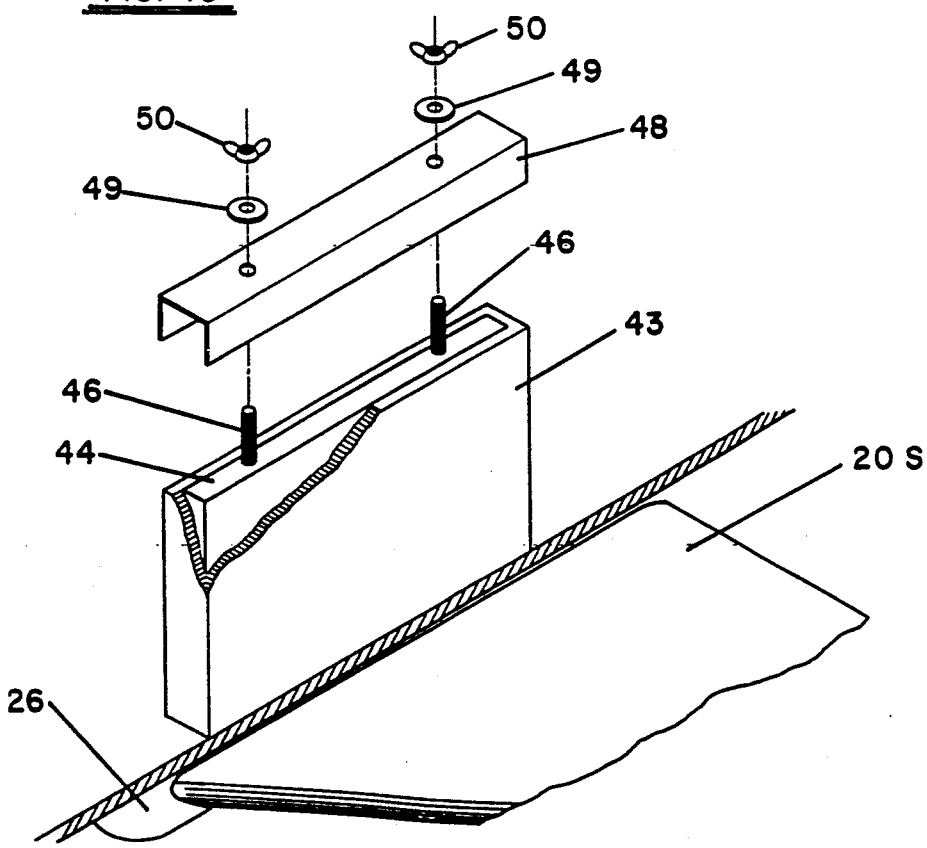
FIG. 13 shows a means of attaching a keel system to a daggerboard boat.

FIG. 13 shows a means of attaching a keel system in the lee keel arrangement to a sailboat with a daggerboard trunk 43. A plug 44 that fits inside trunk 43 is built into base 26 as part of its structure. Plug 44 is inserted into trunk 43 through the bottom of the boat as shown in FIG. 13. The top of plug 44 is fitted with two studs 46 that are sufficient length to protrude above the top of trunk 43. A cap 48 of sufficient size to cover the top of trunk 43, and with holes that align with studs 46, is placed over the top of trunk 43 so that studs 46 protrude through the top of cap 48. Two washers 49 are placed, one each, over studs 46. Two wing-nuts 50 are threaded, one each, onto studs 46 and drawn tight enough to hold base 26 of the keel system snug against the bottom of the boat.

Figure 14:
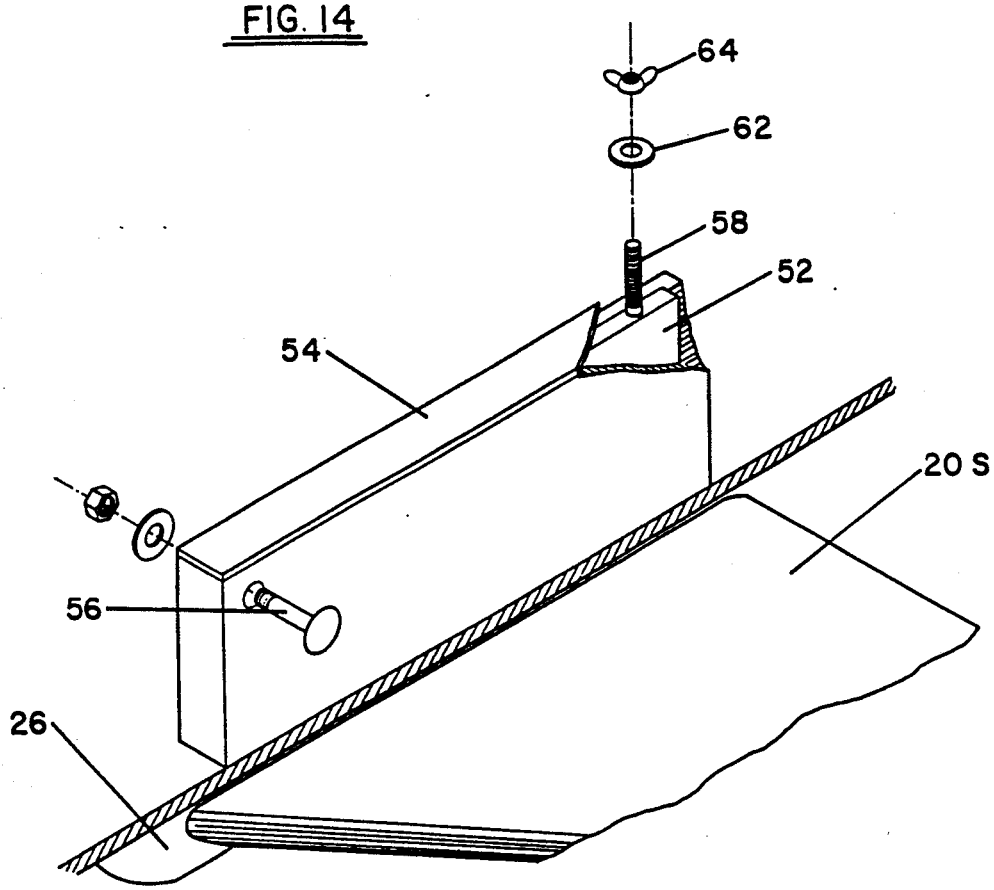
FIG. 14 shows a means of attaching a keel system to a centerboard boat.

FIG. 14 shows a means of attaching a keel system in the lee keel arrangement to a sailboat with a centerboard trunk 54. A plug 52 that fits inside trunk 54 is built into base 26 as part of its structure. Plug 52 is inserted into trunk 54 through the bottom of the boat as shown in FIG. 14. A hole is drilled in the forward end of plug 52 that aligns with the centerboard pivot point in the forward end of trunk 54. A centerboard pivot 56 is inserted through trunk 54 and plug 52 and is fastened in the normal manner designed for the boat. A stud 58 is fixed to the rear end of plug 52 so as to the align with, and protrude through, the pennant hole in the top of trunk 54. A washer 62 is placed over stud 58. A wing-nut 64 is threaded onto stud 58. All holes are aligned so that as wing-nut 64 is tightened, base 26 of the keel system is drawn snug against the bottom of the boat.

OPERATION

In order to illustrate the operation of the present invention, I will describe the forces acting on fins 20P and 20S, and their responses, through a continuous three hundred sixty degree turn starting down wind, turning to port and ending downwind.

Figure 5:
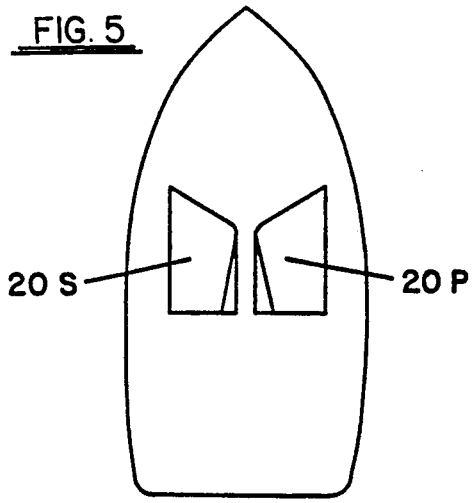
FIG. 5 shows a bottom view of a boat with a windward keel arrangement.

When a sailboat with the present invention, as depicted in FIGS. 3 or 5, is running downwind, there are no lateral forces acting against the hull. The high pressure of water against deactivating surface 36 keeps fins 20P and 20S deactivated and laying flat against the hull of the boat.

Figure 4:
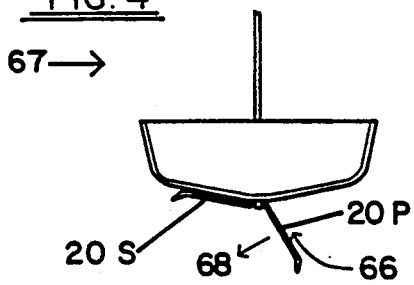
FIG. 4 shows a rear view of the boat in FIG. 3 with the wind off the port side.
Figure 6:
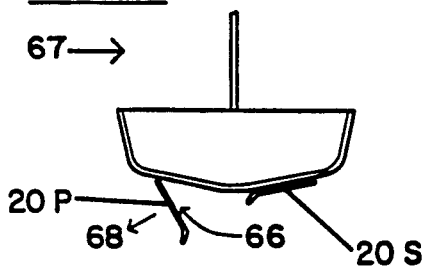
FIG. 6 shows a rear view of the boat in FIG. 5 with the wind off the port side.

As the boat turns to port and the wind 67 blows against the port side of the sail, the hull will encounter higher water pressure on the starboard side as the boat is being blown downward. When these lateral hydrodynamic forces exceed angle 28 set into tab 22 of fin 20P the water pressure on activating surface 38 of fin 20P will be higher than the water pressure on deactivating surface 36 of fin 20P. This will force fin 20P to swing on hinge 24 until it is stopped by limiting surface 25, thus providing directional stability for the boat while it is on a port reach or a port tack, as depicted in FIGS. 4 and 6.

Since fin 20P is activated only when the wind 67 is off the port side of the boat, it can be designed for maximum efficiency on its assigned tack. For example fin 20P is pointed a few degrees of windward of the centerline of the boat. Fin 20P is also shaped in an asymetrical airfoil as shown in FIG. 7, with the low pressure surface to the windward side of the boat. This combination has the effect of reducing, eliminating or even overcoming the boat's tendency to drift leeward of its intended direction of travel.

The efficiency of fin 20P is also enhanced by the fact that it is limited by surface 25 at an acute angle to the horizontal force of leeway pressure. This angle is called negative dihedral in aerodynamic terms, and it has numerous positive effects.

First: As the wind pressure 67 against the port side of the sail increases, the boat heels to starboard and increases the depth of fin 20P thus increasing its efficiency.

Figure 12:
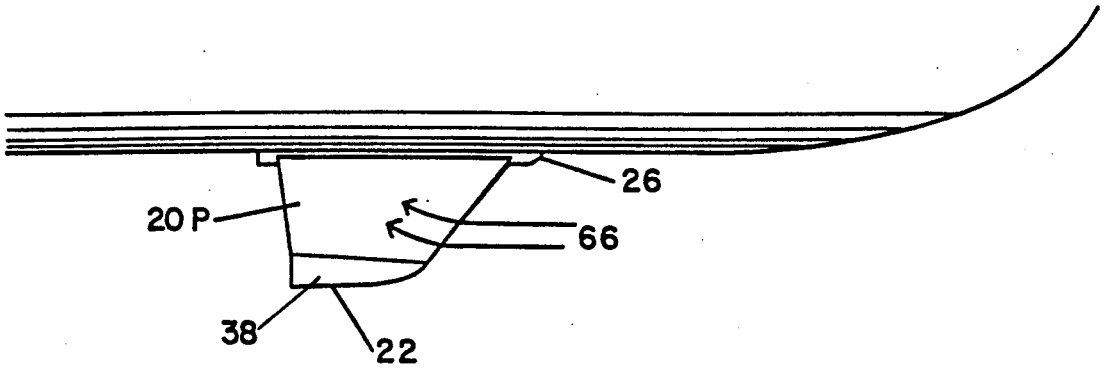
FIG. 12 is a side view of a boat with a fin activated showing fluid flow.

Second: As the high pressure or lee side of fin 20P passes through the water, the flow of water 66 is directed away from the tip of fin 20P as illustrated in FIGS. 4, 6 and 12. This reduces the tendency for a tip vortex to form. The tip vortex is further inhibited by tab 22, which acts as a winglet to direct the high pressure fluid on the lee side of fin 20P away from the low pressure fluid on the windward side of fin 20P.

Third: The windward, or low pressure, side of fin 20P is 'lifting' in a downward direction 68 as illustrated in FIGS. 4 and 6. This has the effect of stabilizing the boat against the heeling torque of wind pressure 67 on the sail. The harder the wind blows, the faster the boat goes, increasing the downward 'lift' generated by fin 20P. Especially in the windward arrangement FIGS. 5 and 6, this effect may reduce or eliminate the need for ballast in some boats.

Fourth: The combination of the swept back leading edge of fin 20P, and its acute angle of deployment 32, presents an obtuse angle to its direction of forward movement. If fin 20P strikes a submerged object, it will tend to swing safely upward and leeward on hinge 24 until the submerged object has been cleared. This will reduced or eliminate the possibility of damage to fin 20P, or the hull of the boat, if a submerged object is struck. This effect also allows fin 20P to swing against the hull of the boat if it is beached or pulled over the rollers of a trailer.

Referring to FIGS. 3, 4, 5 and 6, fin 20S is a mirror image of fin 20P. When fins 20P and 20S are both installed on a boat, a complete keel system for all points of sail results. The fins 20P and 20S may be installed in either the lee keel arrangement FIGS. 3 and 4, or the windward keel arrangement, FIGS. 5 and 6.

As described earlier in this text, a boat with the present invention on a port reach or a port tack has fin 20P activated. During these points of sail, fin. 20S remains inactive because the water flow exerts pressure on its deactivating surface 36.

When a sailboat with the present invention changes tack, that is, points from port tack, through the eye of the wind to starboard tack, the wind is blowing against the starboard side of the sail. When this change occurs, fins 20P and 20S change position. Fin 20S encounters higher pressure on its activating surface 38 than on its deactivating surface 36. This pressure forces fin 20S down against limiting surface 25 to provide directional stability for the sailboat while it is on a starboard reach or a starboard tack.

When the tack from port to starboard occurs, fin 20P no longer has high pressure on its starboard side, which has suddenly become the windward, or low pressure side, of fin 20P. This, plus the forward movement of the boat causing high pressure on deactivating surface 36 forces fin 20P to its inactive position against the hull of the boat where it remains while the wind is off the standard side of the boat.

All the advantages described for fin 20P while the sailboat is on a port reach and port tack, apply for fin 20S while the sailboat is on a starboard reach and starboard tack.

As the sailboat continues to turn to port and approaches a heading downwind to complete its three hundred and sixty degree turn, the high pressure on the lee side of fin 20S, diminishes until, it is overcome by the high pressure on deactivating surface 36 of fin 20S. At this point fin 20S swings on hinge 24 to its inactive position against the hull of the boat. The sailboat is again heading downwind with both fins 20P and 20S folded against its bottom.

A three hundred and sixty degree turn to starboard may be visualized if the reader will re-read the above description and interchange the words port and starboard, and also interchange references to 20P and 20S.

Thus the reader will see that the keel system of the present invention provides safe and efficient directional stability for a small sailboat on all points of sail without the need for crew intervention or cumbersome fixtures inside the hull.

While the above description contains many specifities, these should not be construed as limitations on the scope of the invention, but rather as an exemplification of one preferred embodiment thereof. Many other variations are possible. For example a single fin 20P may be installed on the port pontoon of an unlimited hydroplane to provide turning stability on its counter clockwise oval course without de-stabilizing the craft in the event of a right turn. A modified version of the windward arrangement may be installed on an airboat to provide extra turning stability. A supertanker, while operating empty, may have a need for the part-time stability that a version of the invention would provide.

Accordingly, the scope of the invention should be determined not by the embodiments illustrated, but by the appended claims and their legal equivalents.

I claim:

1. A self activating stabilizer for a craft operating in a fluid medium, comprising:

(a) a fin means, which is pivotally mounted to the body of said craft such that said fin means swings on an axis that is approximately parallel to the intended direction of travel of said craft, and (b) a limiting means such that the movement of said fin means relative to the body of said craft is restricted to a pivotal arc that is defined by said body and an acute angle to the direction of deviant fluid flow that is to be controlled by said fin means, and (c) an activating means, shaped into said fin means, that offers a surface of the unacceptable angles of fluid flow across said body causing said fin means to swing away from said body to the acute angle defined by said limiting means thereby stabilizing said craft against undesireable angles of attack, and (d) a deactivating means, shaped into said fin means, that offers a surface to the acceptable angles of fluid flow along said body causing said fin means to swing against said body thereby reducing the resistance to the foreward progress of said craft.

2. A self activating stabilizer according to claim 1 characterized in that the fin means is in the form of an airfoil section.

3. A self activating stabilizer according to claim 1 further including a fairing fixture built onto the body of the craft foreward of the leading edge of the fin means thereby further reducing resistance to foreward progress when said fin means is deactivated.

4. A self activating stabilizer according to claim 3 characterized in that the fin means is in the form of an airfoil section.

5. A self activating stabilizer according to claim 1 further including a nest, built into the body of the craft, to accept the shape of the fin means such that a reduced surface of said fin means protrudes from said body when said fin means is deactivated thereby reducing resistance to foreward progress when said fin means is deactivated.

6. A self activating stabilizer according to claim 5 characterized in that the fin means is in the form of an airfoil section.

7. A keel system, comprising; a plurality of self activating stabilizers as depicted in claim 1, 2, 3, 4, 5 or 6, arranged such that said self activating stabilizers activate and deactivate in response to a variety of conditions.

8. A keel system as depicted in claim 7 mounted on a common base, said base having a means of being affixed to a sailboat through a daggerboard trunk such that said keel system replaces the function of a daggerboard.

9. A keel system as depicted in claim 7 mounted on a common base, said base having a means of being affixed to a sailboat through a centerboard trunk such that said keel system replaces the function of a centerboard.

* * * * *

UNITED STATES PATENT AND TRADEMARK OFFICE

CERTIFICATE OF CORRECTION

PATENT NO. : 5,009,178

DATED : April 23, 1991

INVENTOR(S) : Henry P. Geffken

It is certified that error appears in the above-identified patent and that said Letters Patent is hereby corrected as shown below:

Column 1, line 31, change "The" to --These--.

Column 1, line 60, change "spaced" to --space--.

Column 3, line 67, after "that are" insert --of--.

Column 4, line 18, delete "the" (2nd occur.).

Column 4, line 41, change "downward" to --downwind--.

Column 5, line 57, change "standard" to --starboard--.

In the claims:

Column 6, line 41, change "of" (1st. occur.) to --to--.

Signed and Sealed this

Fifteenth Day of December, 1992

*Attest:*

*Attesting Officer*

DOUGLAS B. COMER

*Acting Commissioner of Patents and Trademarks*